United States Patent [19]

Venaleck et al.

[11] 3,930,707

[45] Jan. 6, 1976

[54] INTERFACE CONNECTOR

[75] Inventors: John T. Venaleck, Painesville; Kenneth W. Braund, Willoughby, both of Ohio

[73] Assignee: A P Products Incorporated, Painesville, Ohio

[22] Filed: June 10, 1974

[21] Appl. No.: 477,605

[52] U.S. Cl. .... 339/75 MP; 339/91 R; 339/176 MP

[51] Int. Cl.[2] .... H01R 13/54

[58] Field of Search .... 339/17, 75, 95, 176, 91

[56] References Cited

UNITED STATES PATENTS

| | | | |
|---|---|---|---|
| 3,086,189 | 4/1963 | Robbins | 339/176 MP |
| 3,160,459 | 12/1964 | Greco et al. | 339/176 MP |
| 3,173,737 | 3/1965 | Kinkaid et al. | 339/176 MP |
| 3,221,288 | 11/1965 | Eads | 339/176 MP |
| 3,221,289 | 11/1965 | Eads | 339/176 MP |
| 3,278,714 | 10/1966 | Bernutz | 339/176 MP |
| 3,360,767 | 12/1967 | Brown et al. | 339/17 L |
| 3,474,388 | 10/1969 | Jackson et al. | 339/92 R |
| 3,573,706 | 4/1971 | Haberlen | 339/91 R |
| 3,656,087 | 4/1972 | Nutton | 339/95 D |
| 3,731,252 | 5/1973 | McKeown et al. | 339/75 MP |

*Primary Examiner*—Joseph H. McGlynn
*Attorney, Agent, or Firm*—Donnelly, Maky, Renner & Otto

[57] ABSTRACT

A connector for supporting a printed circuit board in electrical and mechanical connection to the wrapping posts or pins of a wire wrap panel without interference to wrapped wire connections at the pins includes a housing, electrical contacts arranged in opposed pairs within the housing for movement between cocked position for receiving the pins and locked position for locking engagement biting into the pins, and means for retaining the printed circuit board in the housing. The contacts are moved to locked position by inserting the leading edge of the printed circuit board into engagement therewith, and each contact provides a connection between an electrical circuit on the printed circuit board and a respective pin.

17 Claims, 8 Drawing Figures

INTERFACE CONNECTOR

BACKGROUND OF THE INVENTION

This invention relates to a connector for providing an interface between circuits on a printed circuit board or the like and a plurality of electrically conductive pins, and more particularly relates to such an interface connector for secure attachment to the wire wrapping posts of a wire wrap panel and to a printed circuit board.

It is common in computer technology to find within the electrical structure of a computer one or more wire wrap panels, each of which has an attachment side constituting a mother board for attachment of a plurality of daughter printed circuit boards and a wrapping side. A plurality of wire wrapping posts, referred to hereinafter as pins, are electrically connected to respective circuits on daughter printed circuit boards and extend outwardly on the wrapping side of the panel, whereby one or more wire conductors may be wrapped to respective pins, which usually have a square cross-section and are of a length sufficient to permit the wrapping of from one to four wires in the same substantially cylindrical plane thereabout. Thus, the primary purpose for the wire wrap panels is to provide for interconnection between various logic circuits or the like on various daughter printed circuit boards as well as to facilitate connection to other parts of a computer or the like external of the given wire wrap panel.

It is often desirable to modify an already existing computer or the like, for example, by adding additional circuits to increase or to modify function capability, to reduce the time required to complete a function, etc. To rewire the wire wrapping side of respective wire wrap panels, however, would be virtually impossible due to the large number of wire conductors often found there. One technique for effecting such modification has been to use removable connections for the daughter boards at the attachment side of the wire wrap panel, whereby modified daughter printed circuit boards may be substituted for the original daughter boards; however, this technique suffers from the disadvantage that the size of the daughter boards is usually limited, and the computer manufacturers are generally opposed to this type of modification. Moreover, connection of supplemental printed circuit boards to the pins on the wire wrapping side of the panels has not been possible, for the wrapped wire conductors often cover a substantial portion of many of the pins and do not leave sufficient pin length for connection to a conventional connector; moreover, there are no mechanical attachment supports for such connectors and/or supplemental printed circuit boards attached thereto for good mechanical connection and support to the wrapping side.

SUMMARY OF THE INVENTION

The interface connector of the invention provides a plurality of electrical interfaces or connections between the pins on a wire wrap panel and respective circuits on a supplemental daughter printed circuit, and such connector includes a locking mechanism for sufficiently secure attachment to the pins to be capable of supporting the supplemental daughter board. Normally the daughter board would first be inserted into the connector for retention thereby, and further insertion effects a locking attachment of the connector contacts to respective panel pins, the connector being capable of such attachment to only approximately a 0.050 inch length of the pins without ancillary support. Thus, mechanical and electrical connection is made with the pins without interference to the respective wrapped connections. The connector also may be used to provide connections to connector pins in a plug and socket-type arrangement or in any other arrangement wherein a plurality of extending electrical pins are to be electrically connected to circuits on a printed circuit board or the like.

Accordingly, a primary object of the invention is to attach a printed circuit board to a plurality of pins to establish electrical connections between circuits on the former and respective pins.

Another object of the invention is to attach a printed circuit board to a plurality of pins located, for example, on a wire wrap panel, connector or the like, by an interface connector and to retain the printed circuit board to such interface connector.

A further object of the invention is to attach electrically to the circuit features of a wire wrap panel without disturbing existing circuit features thereof.

An additional object of the invention is to provide additional circuit capability to the wrapping side of a wire wrap panel without disturbing the wrapped wire connections thereon.

Still another object of the invention is to facilitate modification of a computer or the like by providing additional circuit feature capability at the wrapping side of wire wrap panels thereof.

These and other objects and advantages of the present invention will become apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENT

Figure 1:
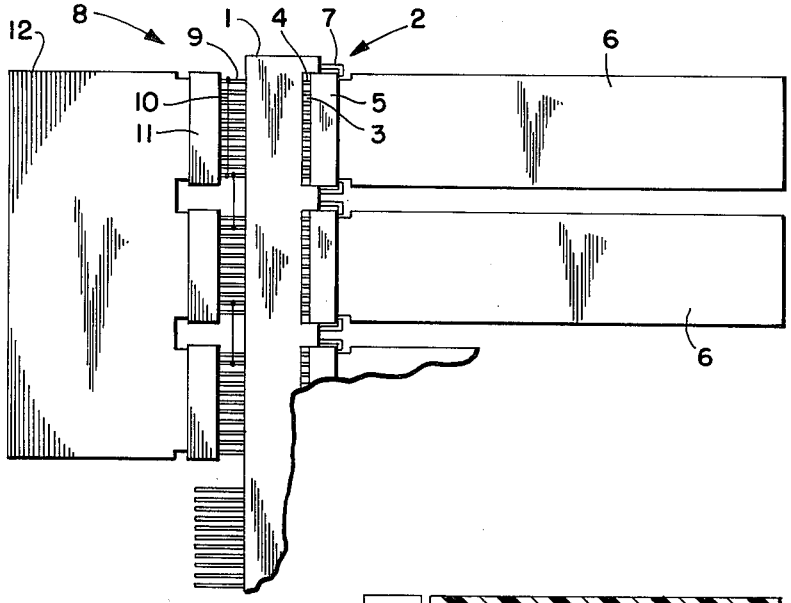
FIG. 1 is a partial plan view of a wire wrap panel to which connectors in accordance with the invention are attached at the wire wrapping side.

Referring now to the drawings, wherein like reference numerals refer to like elements in the several figures, there is illustrated in FIG. 1 a conventional wire wrap panel 1, adapted for use, for example, in a computer or the like. The attachment side 2 of the wire wrap panel 1 includes a number of recesses 3 into which a plurality of connector pins 4 extend from the interior of the panel, and conventional edge board connectors 5, which are coupled to respective conventional daughter printed circuit boards 6 containing logic circuits or the like, are attached to the connector pins in the recesses and are firmly retained in position by hold down members 7. The hold down members 7 also may conventionally be designed for direct engagement with the daughter boards 6 and may comprise screws, brackets, springs, or the like.

On the wrapping side 8 of the panel 1 are a plurality of wire wrapping posts or pins 9, normally of square cross-section for coaction with conventional wire wrapping tools, and each respectively connecting with one of the connector pins 4 on the attachment side 2. A plurality of insulated wire conductors 10 are wrapped in electrically conductive engagement with respective pins 9 to provide interconnection between circuits on one or more daughter boards 6 and for interconnections between plural panels 1. For clarity of illustration only three such wires 10 are illustrated in FIG. 1, although under normal circumstances the wrapping side 8 of the panel 1 would be quite filled with such wires. Moreover, it can be seen from the figure that although the attachment side 2 of the wire wrap panel 1 has several means, including recesses 3 and hold down members 7, to assure good mechanical support of the edge board connectors 5 and daughter boards 6, no such ancillary means are usually provided on the wrapping side 8.

A plurality of interface connectors 11 in accordance with the invention are illustrated coupled to respective pins 9, and an enlarged supplemental daughter printed circuit board 12 is coupled to three of such interface connectors, although if desired larger or smaller supplemental daughter boards coupled to one or more such interface connectors may be used. Each interface connector 11 provides for secure mechanical and electrical attachment to the pins 9, supports the supplemental printed circuit board 12, and provides an electrical interface between the pins 9 and respective circuits on the supplemental daughter board 12, the circuits on the latter, for example, supplementing the original circuit capacity of the computer in which the panel 1 is used.

As will become more apparent from the description below, in normal use of the interface connectors 11, the supplemental daughter board 12 first would be partially inserted into the same, and then the combination would be positioned relative to the pins 9. Further insertion of the supplemental daughter board 12 into the interface connector 11 would cause the latter to lock onto the pins. Moreover, the interface connector 11 and supplemental daughter board 12 may readily be removed from the pins 9 simply by withdrawing the supplemental daughter board to the left, which effects unlocking of the former enabling complete removal from the pins. Normally, however, after having been inserted in the interface connector 11, the supplemental daughter board will be retained thereby, albeit in a loose fitting connection.

Figure 2:
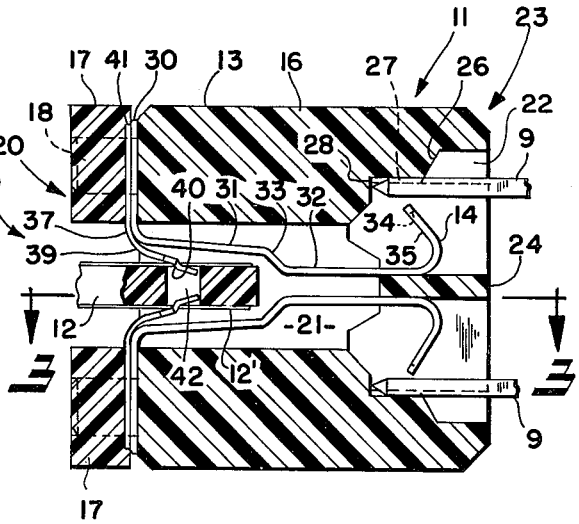
FIG. 2 is a cross-section side view of an unlocked interface connector in accordance with the invention.
Figure 5:
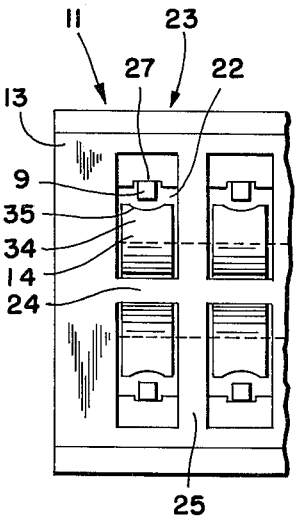
FIG. 5 is a front view of the unlocked connector of FIG. 2.
Figure 6:
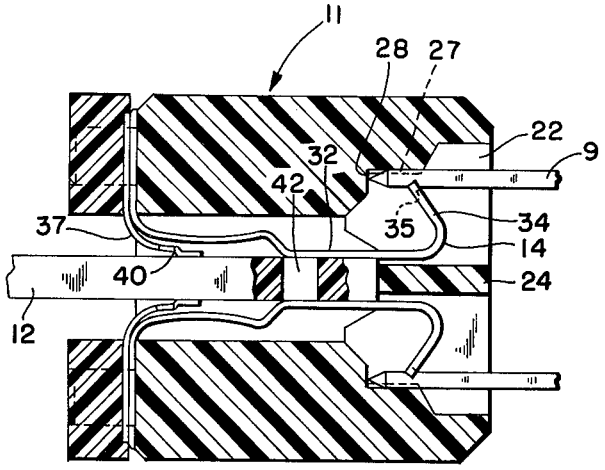
FIG. 6 is a cross-section side view of a locked interface connector in accordance with the invention.
Figure 7:
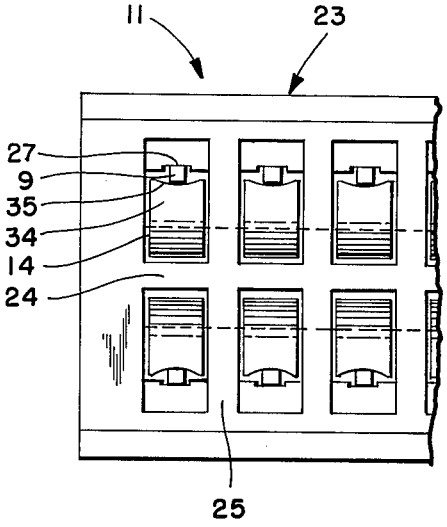
FIG. 7 is a front view of the locked connector of FIG. 6.

Turning now more particularly to FIGS. 2 through 7, the interface connector 11 is illustrated in operative unlocked position relative to a pair of pins 9 in FIGS. 2 through 5 and in locked position in FIGS. 6 and 7; for clarity, however, the supplemental daughter board 12 is shown only in FIGS. 2 and 6, and in the former greatly enlarged conductive paths 12' are also illustrated for clarity. The interface connector 11 comprises three fundamental elements, including a dielectric housing 13, electrical contacts 14, and a daughter board retention mechanism generally indicated at 15. The housing comprises a main body portion 16 to which a pair of contact holding covers 17 are fitted on stubs 18 and ultrasonically welded or otherwise fastened in place, and the retention mechanism 15 couples the interface connector 11 with the supplemental daughter board 12 for convenience of manipulation including insertion and removal relative to pins 9.

Preferably, the dielectric housing 13 is molded with glass filled nylon for strength, durability and electrical insulating properties. An opening in the rear face 20 of the housing opens to a cavity or space 21 formed within the dielectric housing 13 for receiving the leading edge and forward-most portion of the supplemental daughter board 12 on which a plurality of printed circuit terminals are located. Moreover, a plurality of socket-type pin receiving openings 22 are defined in the front face 23 of the dielectric housing 13 between lattice divider members 24, 25 molded integrally with the main body portion 16. Each of the openings 22 includes a sloped surface 26 for pin guidance fully into the opening, a shallow channel 27 for proper pin alignment, and a stop surface 28 perpendicular to the insertion direction of the pin to limit the maximum insertion depth thereof. Moreover, the lattice members 24, 25 also provide for pin alignment and electrical isolation therebetween.

The electrical contacts 14 are positioned in the housing in two rows or lines of opposed contact pairs for force balance between respective rows of pins 9, and such contacts have a dual role of providing both electrical and mechanical connecting functions. Each of the contacts 14 includes a tail portion 30, cantilever portions 31, 32 coupled by an offset bend 33, and a locking portion 34, which includes a concave curved cut out 35 (FIG. 5); and besides being electrically conductive, the contacts are hard relative to the pins 9 for biting action into the latter for locking engagement therewith. Preferably the radius of curvature of the cut outs 35 is larger than the edge dimension of a square pin 9 to facilitate the mentioned biting action.

Moreover, each of the tail portions 30 has a pair of concave cut outs 36 to facilitate positioning between adjoining posts 18 for contact alignment in the housing 13. The cantilever portions 31, 32 of each contact normally extend at slightly greater than a right angle to the tail portion 30 thereof, whereby the forward-most part of the cantilever portion 32 abuts the lattice member 24 so that clearance between the contact cut out 35 in the locking end portion 34 and the channel 27 is provided to permit respective pins 9 to be located in the latter in abutment with stop surfaces 28, as clearly illustrated in FIGS. 2, 3 and 5. The locking end portion preferably extends in a reverse curved or acute angle relative to the cantilever portion 33 to facilitate locking on the pins 9 without interference with wrapped conductors on the latter and to prevent withdrawal from the pins when locked thereto.

Figure 3:
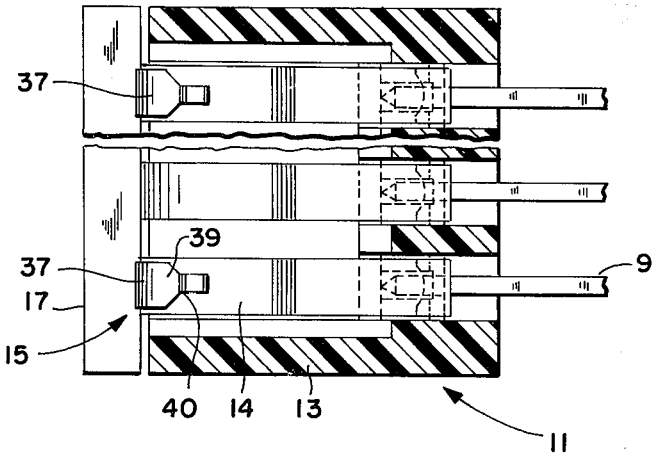
FIG. 3 is a top view of the unlocked connector of FIG. 2 taken on the lines 3—3 thereof with the supplemental daughter printed circuit board removed.
Figure 4:
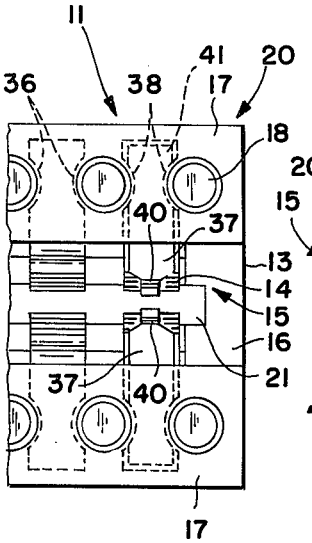
FIG. 4 is a rear view of the unlocked connector of FIG. 2 with the supplemental daughter printed circuit board removed.

The supplemental daughter board 12 retention mechanism 15 includes two pairs of tangs 37 positioned in overlying relation to respective contact tails 30 at spaced apart locations along the contact rows of the interface connector, as shown, for example, in FIG. 3. Each of the tangs is attached to the housing 15 in a manner similar to the method for attachment of the contact tails 30, as shown, for example, in FIG. 4, using respective concave recesses or cut outs 38 at the edges of the tangs. Forward cantilever portions 39 divided by an offset bend 40 of the tangs extend into the space 21 of the interface connector 11 and are bent so as normally to extend at an obtuse angle relative to the tail portions 41 of the tangs. Moreover, the supplemental daughter boards 12 have at least two holes 42 drilled through the same to cooperate with respective tang pairs for retention of the printed circuit board in the interface connector 11, i.e. to preclude removal thereof.

In operation of the interface connector illustrated in FIGS. 2 through 7, a supplemental daughter printed circuit board 12 is at least partially inserted into the space 21 in loose fitting or clearance engagement with the contacts 14, whereby the latter remain cocked and the tangs 37 fit into the holes 42 to preclude removal of the former. The locking portions 34 of the contacts 14 in cocked position remain in abutment with lattice member 24. The combined interface connector and supplemental daughter board is then positioned relative to a pair of pin rows including respective pins 9, whereby the pins are guided between the lattice members 23, 24 and by sloped surface 26 into channels 27 and are stopped at stop surfaces 28.

Further insertion of the supplemental daughter board 12 as guided by the offset bends 33 urges the locking portions 34 of the contacts 14 into locked position in engagement with the respective pins 9, whereby the contacts at the cut outs 35 bite into the pins and firmly lock into the same. Thus, in the locked position of the interface connector 11 as seen in FIGS. 6 and 7, the cantilever portions 39 of the tangs 37 are slid out of the holes 42 and along the surface of the supplemental daughter board 12; respective circuits printed on the latter are electrically connected to cantilever portions 32 of the contacts 14; and locking portions 34 of the contacts are securely electrically and mechanically attached to the pins 9. The walls of the channels 27 provide back support for the pins 9, and the mechanical connection of the interface connector 11 to ends of the pins 9 has been found not to interfere with as many as four existing wrapped connections to the latter.

Moreover, the interface connector 11 may be readily removed from the pins 9 simply by withdrawal of the supplemental daughter board 12, to the left as shown in the drawings. During such withdrawal the locking portions 34 of the contacts 14 release from engagement with pins 9 as the leading edge of the supplemental daughter board 12 is moved out of engagement with the contact cantilever portion 32. Also, as the holes 42 become aligned with the cantilever portions 39 of tangs 37, such portions snap into the holes and preclude further withdrawal of the supplemental daughter board from the interface connector 11.

Figure 8:
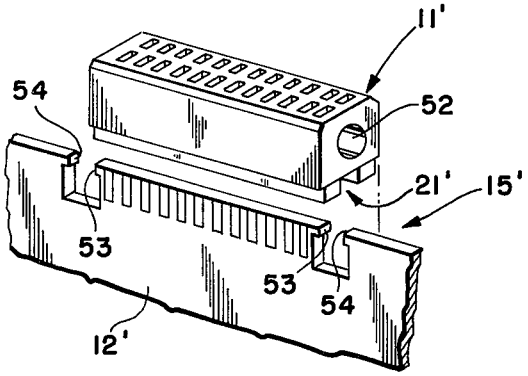
FIG. 8 is an exploded isometric view of an interface connector with a modified retention mechanism for a supplemental daughter printed circuit board.

Referring now to FIG. 8, a modified retention mechanism 15' for retaining a supplemental daughter printed circuit board 12' relative to the interface connector 11' includes a hole 52 at each end of the interface connector and two ramps 53 or similar protruding members on the supplemental daughter board 12', which may be force fitted through the space 21' to protrude into the holes 52. Thus, after the supplemental daughter board is inserted into the space 21' and the protruding members 53 snap into the holes 52, withdrawal of the supplemental daughter board from the interface connector is prevented. The diameter of holes 52 is sufficiently large to permit free movement of the supplemental daughter board 12' relative to the interface connector 11' for cocking and locking action as described above with reference to FIGS. 2 through 7. If desired, an additional ramp 54 may be formed on the supplemental daughter board as illustrated in FIG. 8 in relatively close proximity to the first ramp for further engagement with the respective holes in the interface connector, or the additional ramp may be relatively removed from the first ramp to provide one part of a retention mechanism for connection of the supplemental daughter board to a further interface connector used in a manner similar to that illustrated, for example, in FIG. 1.

We claim:

1. An interface connector for mechanically attaching a printed circuit board or the like to a plurality of electrically conductive pins for mechanical support by such pins and for electrically connecting circuits on such printed circuit board to respective pins, comprising:

an electrically non-conductive housing having forward and rear faces, the former having opening means for receiving inserted pins and the latter including an opening into a space in said housing for receiving an inserted portion of such printed circuit board; and a plurality of electrically conductive contacts supported in relative electrically insulated relation in said housing, said contacts being movable in said housing between locked and unlocked condition with respect to such inserted pins, each contact having a forward locking end means for strong mechanical and electrical attachment to a respective pin and a rearward end means for wiping engagement with a received printed circuit board to make electrical contact with a respective circuit printed on the latter;

each contact rearward end means including means responsive to insertion of such printed circuit board into said housing opening for urging said forward locking end means of said contact from unlocked condition to locked condition with a respective pin for mechanical support of said connector and printed circuit board by such pins.

2. An interface connector as set forth in claim 1, wherein said contacts are positioned in said housing in opposed pairs for force balance between rows of pins to which the interface connector is connected.

3. An interface connector as set forth in claim 1, wherein said housing comprises a main body portion and a plurality of contact holding cover portions, said contacts being retained between the former and a respective cover portion, said cover portions being ultrasonically welded to said main body portion.

4. An interface connector as set forth in claim 1, wherein at least said locking end means of each contact comprises hard metal relative to that of the electrically conductive pins, and upon being forced into locking engagement with a respective pin, said locking end means bites into the metal thereof.

5. An interface connector as set forth in claim 4, wherein said locking end means includes a concave recess having a radius of curvature larger than the edge dimension of an electrically conductive pin to facilitate such biting.

6. An interface connector as set forth in claim 4, wherein each contact includes a rearward contact tail portion for attachment to said housing proximate said housing rear face, and said rearward end means includes a locking end means, and said cantilever portion being positioned for movement by the leading portion of such inserted printed circuit board to urge said end means into locking engagement with such inserted pin.

7. An interface connector as set forth in claim 6, further comprising an off-set bend in said cantilever portion of each contact and the cantilever portion forward of said off-set bend being located for wiping engagement with a circuit printed on such printed circuit board, and a longitudinal lattice support member integral with and proximate the forward end of said housing and against which the forward ends of said contacts are normally biased, said off-set bends permitting said contacts to remain in unlocked position while such printed circuit board is inserted into said housing opening up to said off-set bends, and further insertion of such printed circuit board into said space beyond said off-set bends effects such wiping engagement and forces said locking end means of said contacts into locking engagement with respective pins.

8. An interface connector as set forth in claim 1, wherein said housing comprises a plurality of lattice members at the forward end thereof, said lattice members including a longitudinal central support and a plurality of dividers defining openings into which respective pins may be inserted.

9. An interface connector as set forth in claim 8, wherein said housing comprises guide means within each said opening for guiding respective pins within the same to respective locations for engagement by respective contacts when the latter are urged to locked engagement with such pins.

10. An interface connector as set forth in claim 9, wherein said housing comprises a stop surface defining the maximum extent of insertion of each such pin, and a lateral support surface for each such pin when engaged by a locking end means of a respective contact.

11. An interface connector as set forth in claim 1, further comprising means for retaining such printed circuit board in said housing.

12. An interface connector as set forth in claim 11, wherein said means for retaining comprises a plurality of tang members, each being positioned in overlying relation with a respective contact and said contacts and tang members being attached to said housing, each tang member including a resilient cantilever portion extending forwardly into said space in said housing in the insertion path of such an inserted printed circuit board, and a plurality of holes in such printed circuit board positioned for alignment with respective tangs upon insertion into said space in said housing, said tangs, printed circuit board, holes in the latter, and space being related such that upon insertion into said space such printed circuit board deforms said tangs against the resilient force of their cantilever portions and at a point during such insertion said tangs snap into respective holes to preclude withdrawal of such printed circuit board.

13. An interface connector as set forth in claim 12, wherein said contacts are positioned in two rows of opposed contact pairs, and said tangs comprise at least two pairs of opposed tangs, each pair being positioned to overlie respective opposed contacts proximate opposed ends of said housing.

14. An interface connector as set forth in claim 13, wherein the relationship of said space, said tangs, and said plurality of holes in such printed circuit board permits movement of such printed circuit board within said housing between a position whereby said contacts are in unlocked condition and a position to urge said contacts to locked condition.

15. An interface connector as set forth in claim 11, wherein said means for retaining comprises a laterally protruding member proximate the forward edge of such printed circuit board, and a hole in a side of said housing, whereby said protruding member may be force fitted into said housing into said hole as such printed circuit board is inserted into said space, thus precluding withdrawal of the printed circuit board from the housing.

16. An interface connector as set forth in claim 15, wherein said means for retaining comprises two laterally protruding members at opposed sides of the leading edge of such printed circuit board, and said holes comprise two holes at opposed sides of said housing.

17. An interface connector as set forth in claim 16, wherein said holes are of a size sufficient to permit movement of such printed circuit board within said housing between a position whereby said contacts are in unlocked condition and a position to urge said contacts to locked condition.

* * * * *